United States Patent [19]

Branan

[11] Patent Number: 5,018,559

[45] Date of Patent: May 28, 1991

[54] INDUSTRIAL FUNNEL APPARATUS WITH OPERABLE LID FOR USE WITH 55 GALLON DRUMS

[75] Inventor: Larry J. Branan, 180A Gilles Rd., Edwards, Ill. 61528

[73] Assignee: Larry J. Branan, Edwards, Ill.

[21] Appl. No.: 432,381

[22] Filed: Nov. 6, 1989

[51] Int. Cl.[5] ..... B65B 39/00

[52] U.S. Cl. ..... 141/339; 141/98; 141/331; 141/333; 141/344; 222/460; 222/556; 251/298; 220/255; 220/571

[58] Field of Search ..... 141/331, 332, 333, 334, 141/335, 336, 337, 338, 339, 340, 341, 342, 343, 344, 345, 98; 220/1 C, 255; 222/460, 556, 510; 251/144, 298

[56] References Cited

U.S. PATENT DOCUMENTS

| | | | |
|---|---|---|---|
| 113,786 | 4/1871 | Mumler | 141/345 |
| 1,083,107 | 12/1913 | Landers | 141/342 X |
| 3,036,746 | 5/1962 | Hagen | 222/556 X |
| 4,022,352 | 5/1977 | Pehr | 222/556 X |
| 4,338,983 | 7/1982 | Hatcher | 141/331 |
| 4,457,458 | 7/1984 | Heinol | 222/556 X |
| 4,703,867 | 11/1987 | Schoenhard | 141/98 X |
| 4,848,600 | 7/1989 | Dark | 222/556 X |

FOREIGN PATENT DOCUMENTS

| | | | |
|---|---|---|---|
| 8200278 | 2/1982 | PCT Int'l Appl. | 222/556 |
| 2041891 | 9/1980 | United Kingdom | 222/556 |

*Primary Examiner*—Ernest G. Cusick

[57] ABSTRACT

A circular funnel apparatus for industrial use with a closeable lid able to set securely on top of a standard 55 gallon drum. This apparatus consists of four different assembled pieces:

1. A funnel with a supporting circular frame body with a cylindrical extruded drain in the bottom of the funnel, able to extend down into a standard bung hole of a 55 gallon drum.
2. A hinged lid fastened to the funnel frame body capable of closing off the funnel by closing the lid or by lifting and rotating the lid 165 degrees opens the funnel into which paint materials can be poured.
3. Fastened to the underside of the lid (attached 90 degrees or perpendicular to the lid) is a cylindrical rod. With the lid in the closed position, the rod is exactly centered over the cylindrical drain in the bottom of the funnel.
4. Fastened to the end of the cylindrical rod, opposite the end which is attached to the lid, is a circular disk that serves as a plug to the cylindrical drain in the bottom of the funnel. With the lid in the closed position, the circular disk fits down into the circular drain of the funnel providing a semi-sealed drain.

1 Claim, 4 Drawing Sheets

INDUSTRIAL FUNNEL APPARATUS WITH OPERABLE LID FOR USE WITH 55 GALLON DRUMS

BACKGROUND OF INVENTION

1. Technical Field

This invention is intended for use with 55 gallon drums and other storage devices located in repair garages, paint shops, and some manufacturing plants. This apparatus sits on top of any standard 55 gallon drum. The 55 gallon drum must have a top lid with a standard bung hole located in the lid.

Currently paints, paint removers, scrap paint, and other deleterious materials are dispensed into storage 55 gallon drums by means of various funnels and other liquid capturing devices or no device at all. Splattering of materials and fumes are most often discharged into work areas by overflowing of such materials and releasing of fumes into the atmosphere.

2. Background Art

Prior art pertaining to funnels and closure structures are U.S. Pat. Nos. 113,786; 1,083,107; 3,036,746; 4,022,352; 4,338,983; 4,457,458; 4,703,867; 4,848,600; U.K. patent no. GB 2,041,891A; and international patent publication no. WO82/00278.

SUMMARY OF THIS INVENTION

The object of the present invention, generally stated, is the provision of capturing industrial liquids, such as paint thinners, by a funnel type apparatus with a closable lid. This funnel type apparatus adapts readily and conveniently to the top of existing 55 gallon drums.

An important object of the invention is that the user can open the lid on the funnel type apparatus when wanting to put liquids into the 55 gallon drum and when the user is finished, the lid can be closed, preventing vapors from escaping from the 55 gallon drum. Also, when the lid is closed, splattered materials within the funnel are covered and hidden from view.

The invention has particular use in paint shops where paint thinners are constantly being poured into 55 gallon storage drums and currently materials can be found on top of the drum and on the floor around the drum.

Certain other objects of the invention will become apparent in following the detailed description of the invention in conjunction with the drawings.

DETAILED DESCRIPTION

Figure 1:
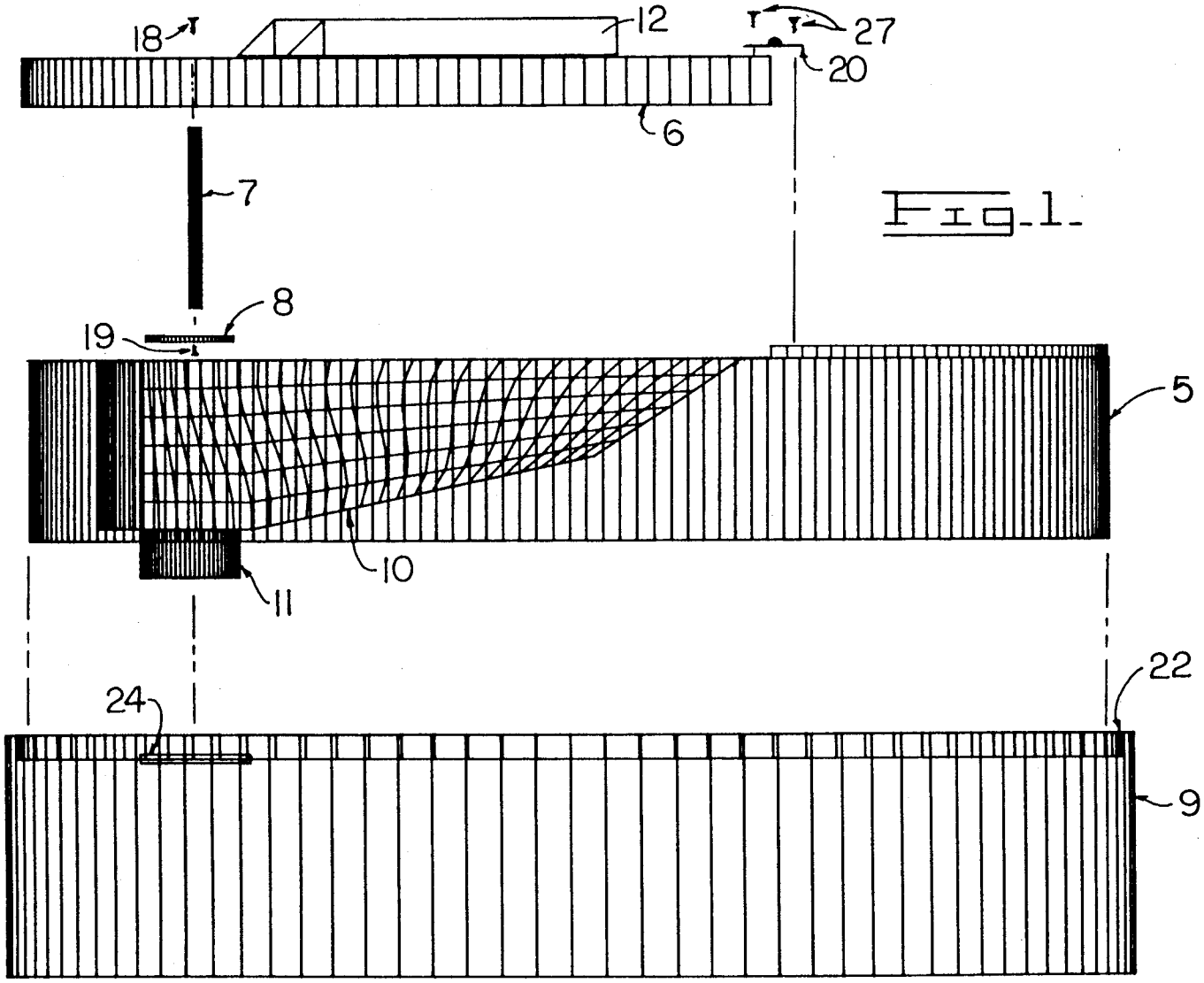
FIG. 1 is an exploded view from the side illustrating the embodiment of the invention. Also, a view of a partial top section of a 55 gallon drum (not part of this invention) showing the preferred mannner for using the embodiment of the invention.

In the drawings, FIG. 1 illustrates an exploded view of an embodiment of the invention; a funnel with supporting circular frame body 5, an operable lid 6, a cylindrical rod 7, and circular disk 8 used for plugging the drain. A partial view of a top section of a 55 gallon drum 9 (not part of this invention) is shown for purpose of illustrating the application of this invention as claimed. The funnel supporting body 5 in FIG. 1 and FIG. 2, shown from a side view, has the hidden lines of the drawing shown for the purpose of illustrating contour of the actual funnel 10 and the drain 11.

Figure 2:
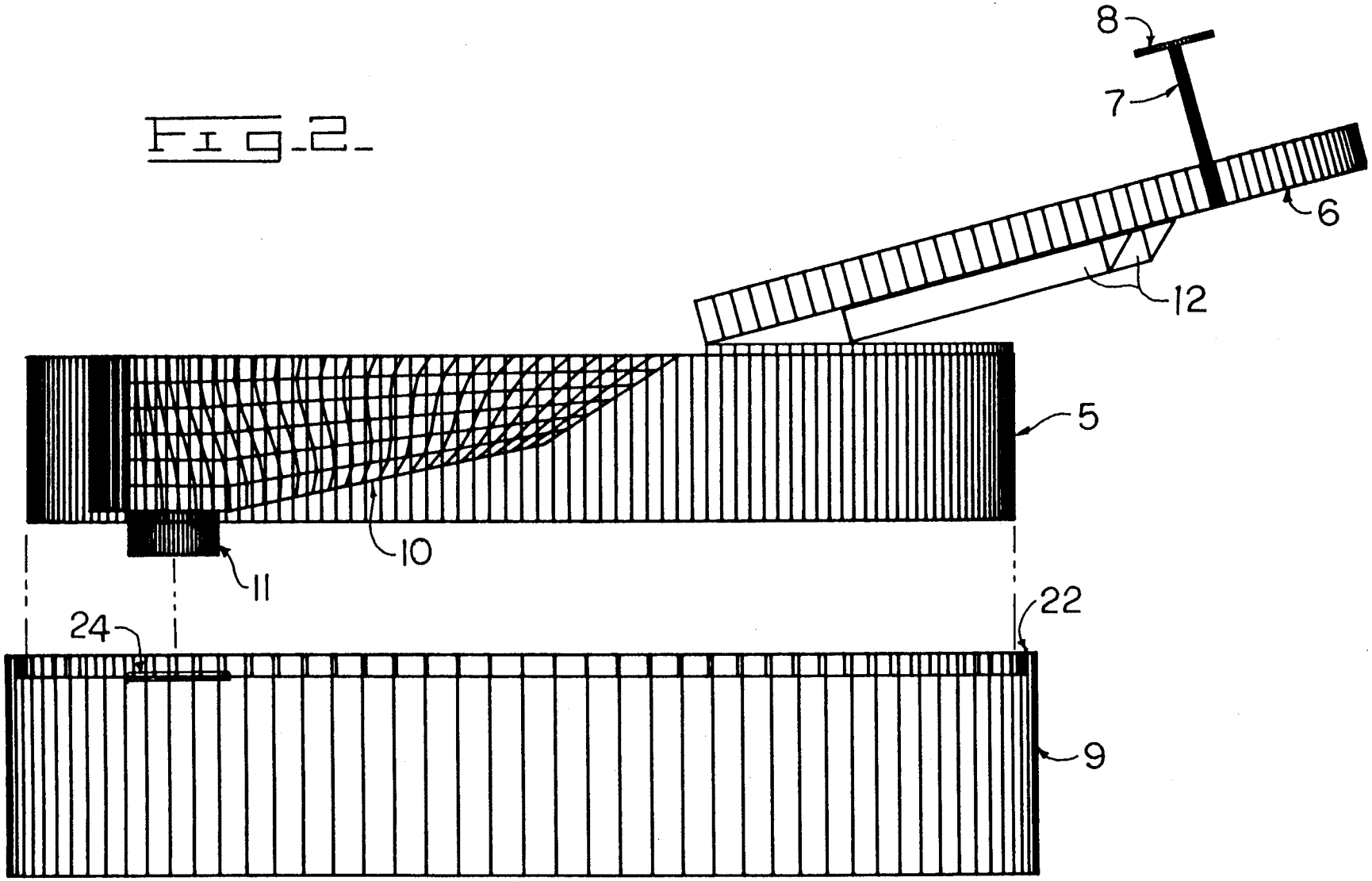
FIG. 2 is a side view of the invention with the lid in the open position. The lid reclines to a position where the formed lid reinforcements rest against the top of the funnel body. The contour of the funnel and drain can be seen from this view.

Fig. 2 illustrates the same view as FIG. 1, but shows the embodiment of the invention in its assembled configuration with the lid 6 in the opened position. Three triangular shaped reinforcement supports 12 provide lateral support for the lid 6. With the lid 6 in the open position, as in FIG. 2 and FIG. 4, the reinforcement supports 12 provide the stop for the lid 6 and the top horizontal surface of the funnel body 5.

Figure 3:
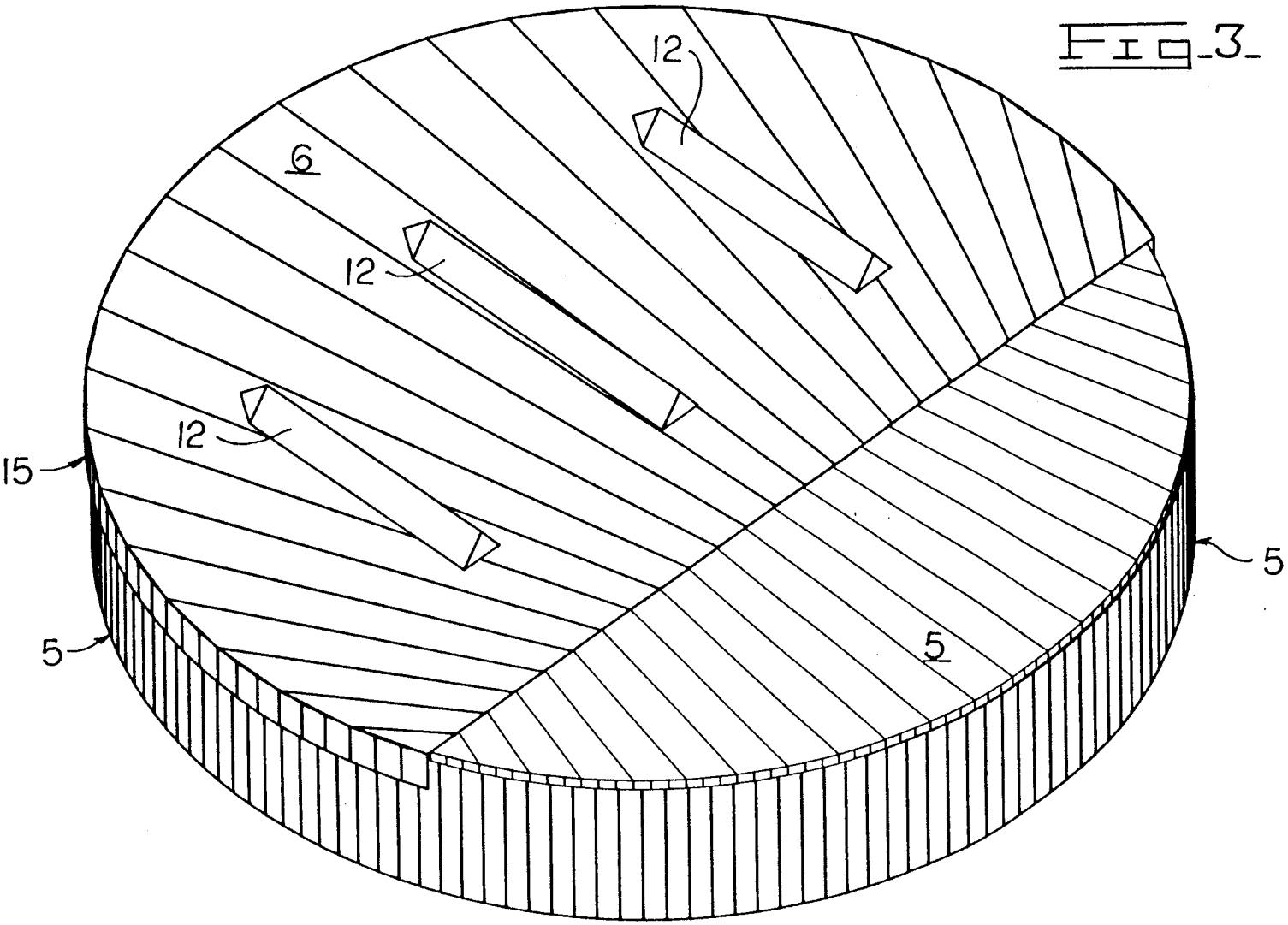
FIG. 3 is a perspective view of the invention with the lid in the closed position.

FIG. 3 illustrates a perspective view of the invention with the lid 6 in the closed position. The lip 16 of the lid 6, protruding downward from the top surface of the lid 6, provides or serves as a handle or catch for the user to open the lid 6 and expose the funnel 10 for use.

Figure 4:
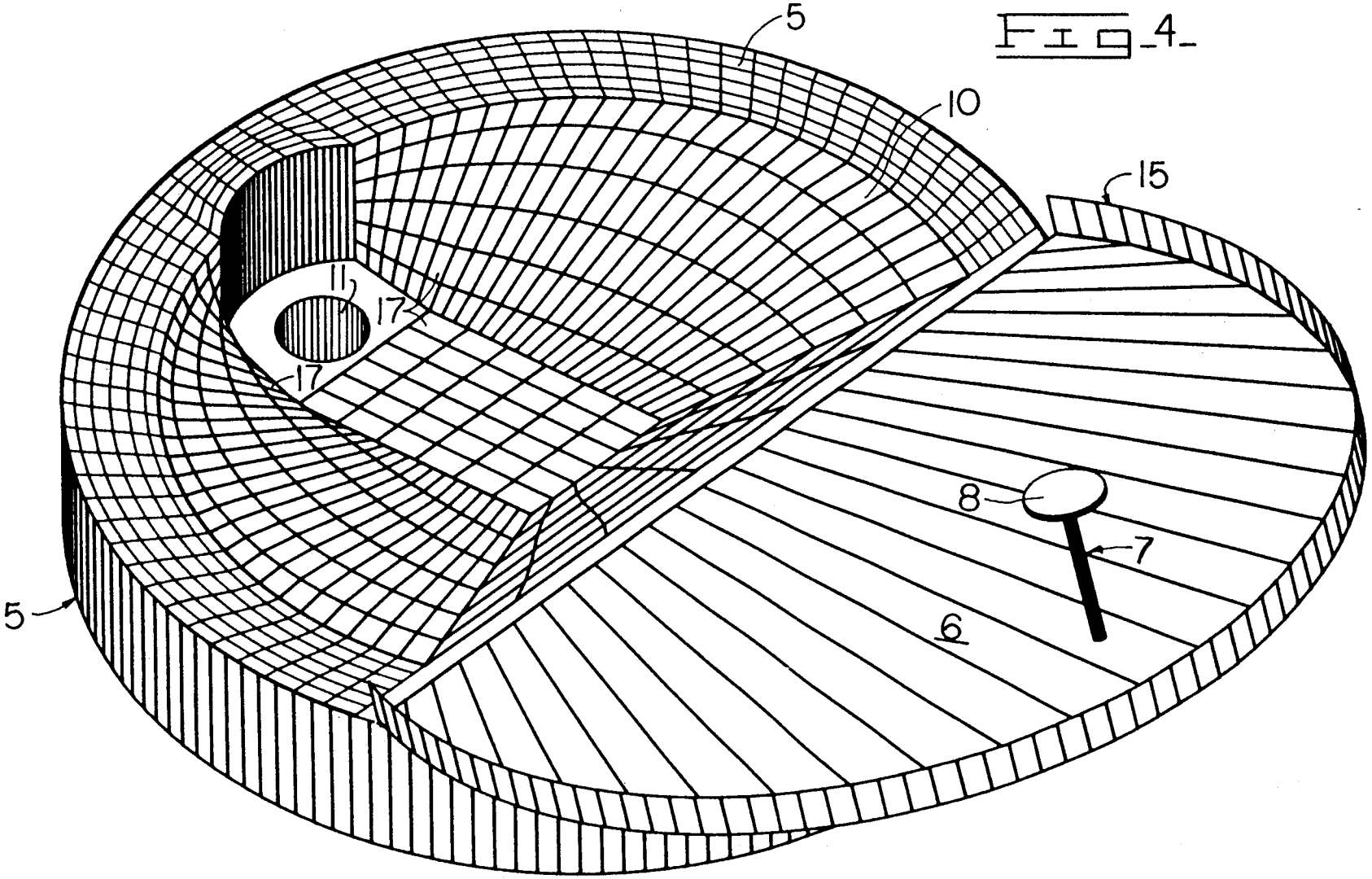
FIG. 4 is a perspective view similar to FIG. 3, but showing the lid in the open position. The interior contour of the funnel can be seen from this view.

FIG. 4 illustrates a perspective view similar to FIG. 3, except the lid 6 is in the open position. The contours of the funnel 10 can be seen. Each interior surface 17 of the funnel 10 slope toward the drain 11 to provide adequate drainage for the liquid material.

The funnel 10 and supporting circular frame body 5 are one piece that may be thermally formed by hard drawn polyethylene plastic. Likewise, the lid 6 and triangular shaped reinforcement supports 12 are one piece formed in the same manner. The cylindrical rod 7 and circular disk 8 may be premanufactured polyethylene plastic cut to size to fit the specifications of the invention.

Referring to FIG. 1, assembly of this invention requires a three step process:

1. Attachment of cylindrical rod 7 to the underside of the lid 6 by positioning a self threading screw 18 through the lid 6 into the end of the cylindrical rod 7.
2. Attachment of the cylindrical rod 7 to the center of the circular disk 8 by positioning a self threading screw 19 through the circular disk 8 into the other end of the cylindrical rod 7.
3. Attachment of the lid 6 to the funnel body 5 by use of a chemically resistant hinge 20 (could be similar to a piano hinge). A series of screws 27 similar to screws 18 and 19 will fasten the hinge 20 to the lid 6 and the hinge 20 to the framed supported body 5. Note: hinge 20 is only featured in FIG. 1.

An important feature of the invention is various paint-related materials poured through the funnel 10 will not stick to the polyethylene plastic. If sticking occurs with thicker paint materials poured through the funnel 10 or sticking to other parts of the invention such as the lid 6, the cylindrical rod 7, the circular disk 8, and the funnel body support 5, the user can flex or bend the above mentioned parts and the paint-related materials will chip or flake off the surface of the said parts.

Another important feature of this invention is that it is easily adaptable to the 55 gallon drum 9. The outer diameter of the funnel support 5 is slightly smaller than the inner diameter of the 55 gallon drum lip 22. Likewise, the outer diameter of the drain 11 is slightly smaller than the inner diameter of the bung hole 24 of the 55 gallon drum 9; therefore, the invention will sit in one secure and stable position on top of the drum 9.

What is claimed is:

1. A funnel type apparatus adapted to capture paint-related liquids, said apparatus adapted to be placed on top of 55 gallon drums, said apparatus comprising: a funnel body having an open top and a bottom having a drain; a lid hinged on the open top being operable for opening and closing the open top; a rod attached at one end to the lid and having a disk at the other end, whereby when said lid is closing said open top said disk acts to plug the drain of said funnel body.

* * * * *